United States Patent [19]

Dastin

[11] Patent Number: 4,986,526

[45] Date of Patent: Jan. 22, 1991

[54] SHEET REGISTRATION CALIBRATION

[75] Inventor: Richard M. Dastin, Fairport, N.Y.

[73] Assignee: Xerox Corporation, Stamford, Conn.

[21] Appl. No.: 411,790

[22] Filed: Sep. 25, 1989

[51] Int. Cl.[5] ..... B65H 9/12

[52] U.S. Cl. ..... 271/227; 271/265; 271/277

[58] Field of Search ..... 271/227, 265, 277, 110

[56] References Cited

U.S. PATENT DOCUMENTS

| | | | |
|---|---|---|---|
| 3,719,267 | 3/1973 | Reist et al. | 198/76 |
| 4,331,328 | 5/1982 | Fasig | 271/270 |
| 4,519,700 | 5/1985 | Barker et al. | 355/35 H |
| 4,634,113 | 1/1987 | Matsuda | 271/277 X |
| 4,718,659 | 1/1988 | Hayashi | 271/277 X |
| 4,804,998 | 2/1989 | Miyawaki | 355/145 H |

*Primary Examiner*—Richard A. Schacher

*Attorney, Agent, or Firm*—H. Fleischer; J. E. Beck; R. Zibelli

[57] ABSTRACT

A method of calibrating registration of a sheet with a sheet gripper on a moving transport. The sheet gripper is adapted to move the sheet in a recirculating path in a printing machine. Movement of the sheet gripper and sheet is timed from a reference time until each reaches a loading zone. The times are compared to a preselected time and the movement of the sheet gripper and sheet adjusted to correspond to the preselected time. In this way, the sheet and sheet gripper arrive at the loading zone simultaneously.

16 Claims, 3 Drawing Sheets

REGISTRATION TIMING

SHEET REGISTRATION CALIBRATION

This invention relates generally to a color electronic reprographic printing system, and more particularly concerns a method of calibrating the movement of a sheet adapted to have a plurality of developed images transferred thereto and the movement of a sheet gripper so that they arrive substantially simultaneously at a loading zone with the sheet being received thereat by the sheet gripper for movement in a recirculating path therewith.

Frequently, the marking engine of an electronic reprographic printing system is an electrophotographic printing machine. In an electrophotographic printing machine, a photoconductive member is charged to a substantially uniform potential to sensitize the surface thereof. The charged portion of the photoconductive member is exposed. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a developed toner image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid material or a powder material.

In order to successfully transfer different color toner images to the copy sheet, the copy sheet moves in a recirculating path. A sheet gripper secured to a transport receives the copy sheet and transports it in a recirculating path enabling successive different color images to be transferred thereto. The sheet gripper grips one edge of the copy sheet and moves the sheet in a recirculating path so that accurate multipass color registration is achieved. In this way magenta, cyan, yellow and black toner images are transferred to the copy in registration, usually about 125 microns between images. To maximize productivity, the sheet gripper usually receives the leading edge of the copy sheet at a loading zone, i.e. area where the sheet is gripped, while moving at process speed without having to stop while the copy sheet is being advanced from the copy sheet stack. The copy sheet is usually advanced from the stack to the loading zone at a faster speed, i.e. twice process speed. Since the copy sheet is coming into the loading zone at high speed, the timing of the copy sheet and the sheet gripper relative to the loading zone is critical to guarantee reliable sheet gripping. The timing latitude is usually very small due to the sheet speed and geometry limitations within the printing system architecture. The copy sheet and sheet gripper timing is generally setup by accurate positioning of the loading zone with respect to the stack, accurate location of the copy sheet and sheet gripper sensors and by trial and error timing of sheet feeding relative to sheet gripper position. Various approaches have been devised for determining the timing of the copy sheet and sheet gripper. The following disclosures appear to be relevant:

- U.S. Pat. No. 3,719,267, Patentee: Reist et al., Issued: Mar. 6, 1973.
- U.S. Pat. No. 4,331,328, Patentee: Fasig, Issued: May 25, 1982.
- U.S. Pat. No. 4,519,700, Patentee: Barker et al., Issued: May 28, 1985.
- U.S. Pat. No. 4,804,998, Patentee: Miyawaki, Issued: Feb. 14, 1989.

The relevant portion of the foregoing patents may be briefly summarized as follows:

U.S. Pat. No. 3,719,267 discloses an apparatus for adjusting the speed of a transport equipped with grippers to the speed of a conveyor arranged ahead of the transport. A first controller regulates the speed of the transport with the grippers as a function of the average speed of a paper stream. A second controller serves to synchronize the movement of the transport with the movement of the individual articles in the stream so that one gripper engages one article.

U.S. Pat. No. 4,331,328 describes a controller for a servo driven document feeder. Sensors positioned along a feeder track detect passage of leading and trailing edges of sheets. A processor responds to the signals from the sensors to determine a natural gap length and adjusts the speed, if required.

U.S. Pat. No. 4,519,700 discloses an electronically gated paper aligner system for use in a xerographic image transfer device. Copy sheets are sequentially aligned and position sensed before introduction to a transfer zone. Position sensing is used to compare the copy sheet location with a moving photoreceptor position. Timing and velocity profiles of the copy sheet are adjusted such that the paper arrives in registration with the image panel on the photoreceptor at the same velocity.

U.S. Pat. No. 4,804,998 describes a sheet transport controller used in a copier. Sheet feed sensors, a registration sensor, a separation sensor, a discharge sensor and others sensors are provided. The timing of the passage of a sheet is detected by a sensor and compared with a reference timing. The resultant difference is fed back to the reference timings assigned to the other sensors downstream of the passage sensor so that accumulated errors do not occur.

Pursuant to the features of the present invention, there is provided a method of calibrating sheet registration with a sheet gripper on a transport, including the steps of timing the movement of the sheet gripper moving with the transport from a first reference position until the sheet gripper arrives at a predetermined location in a loading zone to determine a first time. The movement of the sheet transport is adjusted so that the first time is a preselected time. The movement of the sheet from a second reference position until the sheet arrives at the predetermined location in the loading zone is timed to determine a second time. The movement of the sheet is adjusted so that the second time is the preselected time. In this way, the sheet and the sheet gripper arrive at the loading zone substantially simultaneously.

In another aspect of the present invention, there is provided a method of calibrating registration of a sheet gripper on a moving transport with a sheet. The sheet is adapted to be transported by the sheet gripper in a recirculating path in a printing machine to receive a plurality of different color toner images thereon to form a multicolor image. The method includes the steps of timing the movement of the sheet gripper moving with the transport from a first reference position until the sheet gripper arrives at a predetermined location in a loading zone to determine a first time. The movement of the sheet transport is adjusted so that the first time is a preselected time. The movement of the sheet is timed from a second reference position until the sheet arrives at the predetermined location in the loading zone to determine a second time. The movement of the sheet is adjusted so that the second time is the preselected time. In this way, the sheet and the sheet gripper arrive at the loading zone substantially simultaneously.

Other aspects of the present invention will become apparent as the following description proceeds and upon reference to the drawings, in which.

While the present invention will hereinafter be described in connection with a preferred method of use, it will be understood that it is not intended to limit the invention to that method of use. On the contrary, it is intended to cover all alternatives, modifications and equivalents as may be included within the spirit and scope of the invention as defined by the appended claims.

Figure 1:
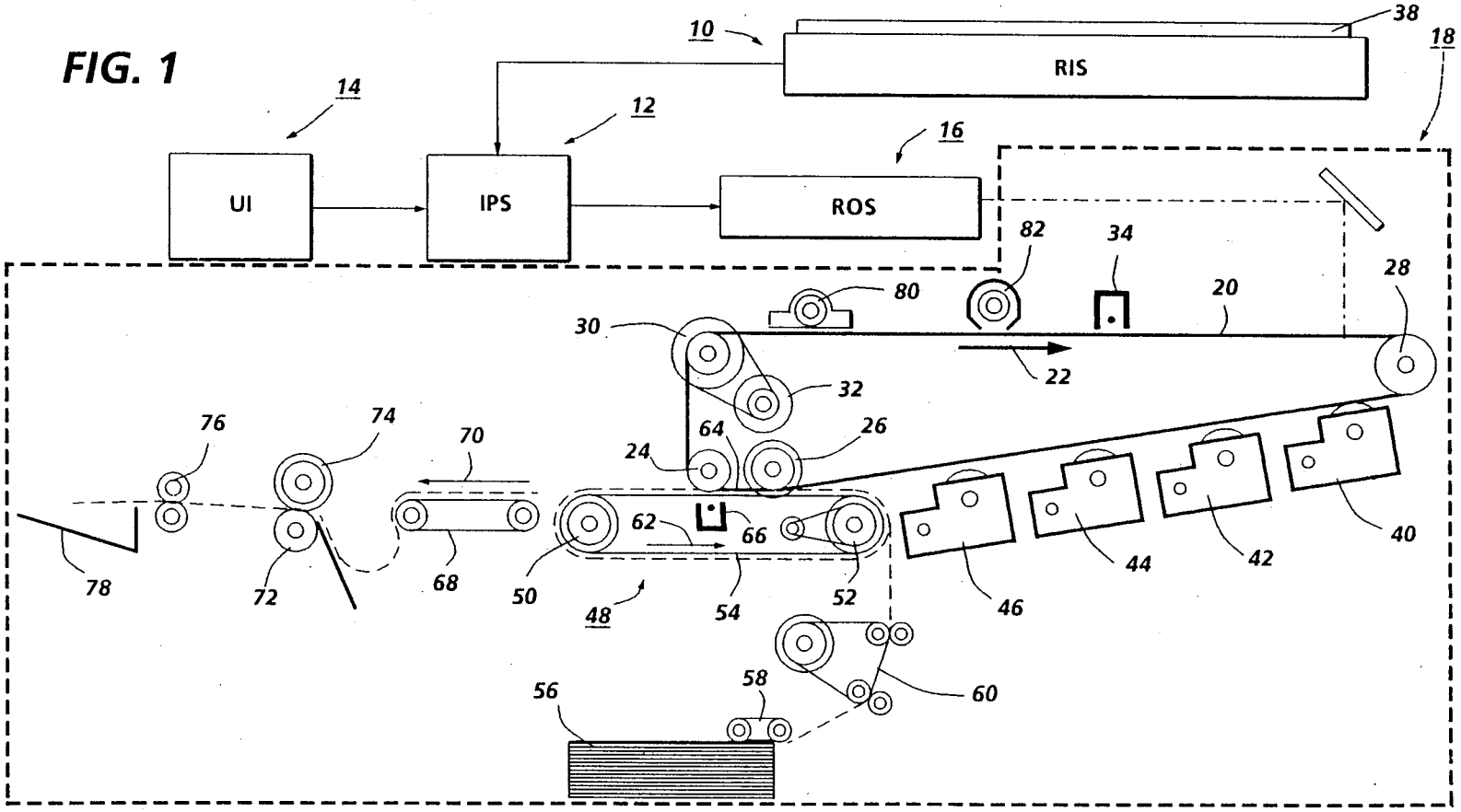
FIG. 1 is a schematic elevational view illustrating an electronic reprographic printing system incorporating the features of the present invention therein.

For a general understanding of the features of the present invention, reference is made to the drawings. In the drawings, like references have been used throughout to designate identical elements. FIG. 1 is a schematic elevational view of an illustrative electronic reprographic system incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 is the control electronics which prepare and manage the image data flow to the raster output scanner (ROS), indicated generally by the reference numeral 16. A user interface (UI), indicated generally by the reference numeral 14, is in communication with the IPS. The UI enables the operator to control the various operator adjustable functions. The output signal from the UI is transmitted to IPS 12. The signal corresponding to the desired image is transmitted from IPS 12 to ROS 16, which creates the output copy image. ROS 16 lays out the image in a series of horizontal scan lines with each line having a specified number of pixels per inch. The ROS includes a laser having a rotating polygon mirror block associated therewith. The ROS exposes the charged photoconductive surface of the printer, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. The electrophotographic printing machine employs a photoconductive belt 20. Preferably, the photoconductive belt 20 is made from a polychromatic photoconductive material. Belt 20 moves in the direction of arrow 22 to advance successive portions of the photoconductive surface sequentially through the various processing stations disposed about the path of movement thereof. Belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through the charging station. At the charging station, a corona generating devices, indicated generally by the reference numeral 34 charges photoconductive belt 20 to a relatively high, substantially uniform potential.

Next, the charged photoconductive surface is rotated to the exposure station. The exposure station includes the RIS 10 having a multi-colored original document 38 positioned thereat. The RIS captures the entire image from the original document 38 and converts it to a series of raster scan lines which are transmitted as electrical signals to IPS 12. The electrical signals from the RIS correspond to the red, green and blue densities at each point in the document. The IPS converts the set of red, green and blue density signals, i.e. the set of signals corresponding to the primary color densities of original document 38, to a et of colorimetric coordinates. The operator actuates the appropriate keys of the UI 14 to adjust the parameters of the copy. UI 14 may be a touch screen or any other suitable control panel, providing an operator interface with the system. The output signals from the UI are transmitted to the IPS. The IPS then transmits signals corresponding to the desired image to ROS 16. ROS 16 includes a laser with rotating polygon mirror blocks. Preferably, a nine facet polygon is used. The ROS illuminates the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material with the third latent image being developed with yellow developer material. The latent images formed by the ROS on the photoconductive belt correspond to the signals from IPS 12.

After the electrostatic latent image has been recorded on photoconductive belt 20, belt 20 advances the electrostatic latent image to the development station. The development station includes four individual developer units generally indicated by the reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 40, 42 and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 10, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of the operative position. In the operative position, the magnetic brush is closely adjacent the photoconductive belt, while, in the non-operative position, the magnetic brush is spaced therefrom. During development of each electrostatic latent image only one developer unit is in the operative position, the remaining developer units are in the non-operative position. This insures that each electrostatic latent image is developed with toner particles of the appropriate color with co-mingling. In FIG. 1, developer unit 40 is shown in the operative position with developer units 42, 44 and 46 being in the non-operative position.

After development, the toner image is moved to the transfer station where the toner image is transferred to a sheet of support material, such as plain paper amongst others. At the transfer station, the sheet transport apparatus, indicated generally by the reference numeral 48, moves the sheet into contact with photoconductive belt 20. Sheet transport 48 has a pair of spaced belts 54 entrained about rolls 50 and 52. A gripper extends between belts 54 and moves in unison therewith. The sheet is advanced from a stack of sheets 56 disposed on a tray. A friction retard feeder 58 advances the uppermost sheet from stack 56 onto a pre-transfer transport 60. Transport 60 advances the sheet to sheet transport 48. The sheet is advanced by transport 60 in synchronism with the movement of the gripper. In this way, the leading edge of the sheet arrives at a preselected position, i.e. a loading zone, to be received by the open gripper. The gripper then closes securing the sheet thereto for movement therewith in a recirculating path. The leading edge of the sheet is secured releasably by the gripper. Further details of the method of calibrating the registration of the sheet with the gripper will be discussed hereinafter with reference to FIGS. 1 and 2. As the belts move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper magnitude and polarity for attracting the toner image from photoconductive belt 20 thereto. The sheet remains secured to the gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner which are transferred, in superimposed registration with one another, to the sheet to form the multi-color copy of the colored original document.

After the last transfer operation, the grippers open and release the sheet. Conveyor 68 transports the sheet, in the direction of arrow 70, to the fusing station where the transferred image is permanently fused to the sheet. The fusing station includes a heated fuser roll 74 and a pressure roll 72. The sheet 52 passes through the nip defined by fuser roll 74 and pressure roll 72. The toner image contacts fuser roll 74 so as to be affixed to the sheet. Thereafter, the sheet is advanced by forwarding roll pairs 76 to catch tray 78 for subsequent removal therefrom by the machine operator.

The last processing station in the direction of movement of belt 20, as indicated by arrow 22, is the cleaning station. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
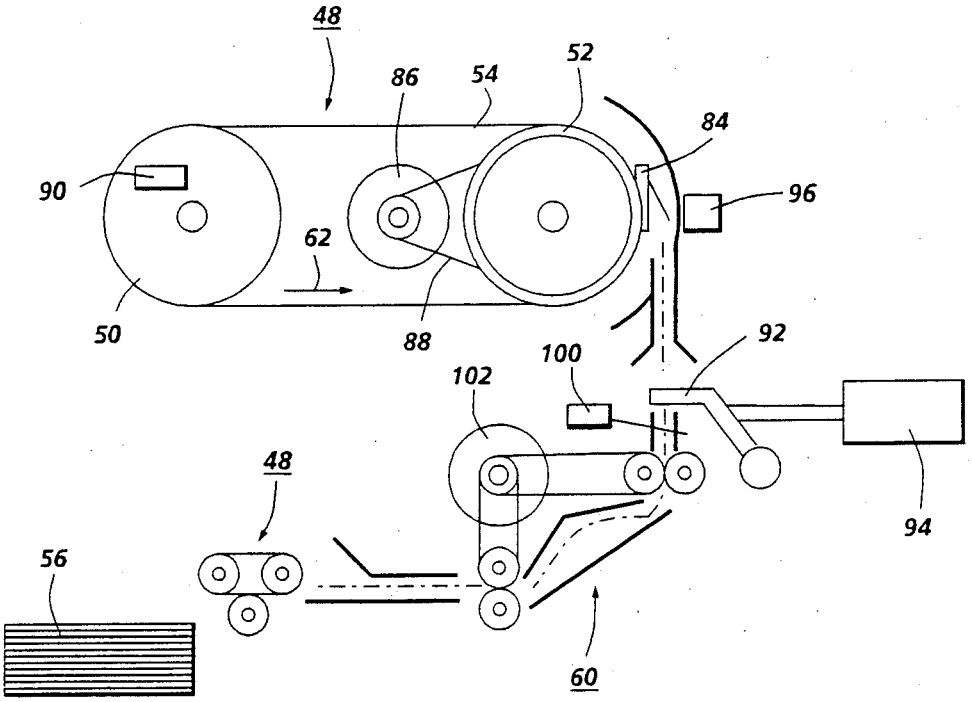
FIG. 2 is a schematic elevational view showing further details of the sheet gripper transport and sheet feeding system used in the FIG. 1 electronic reprographic printing system.
Figure 3:
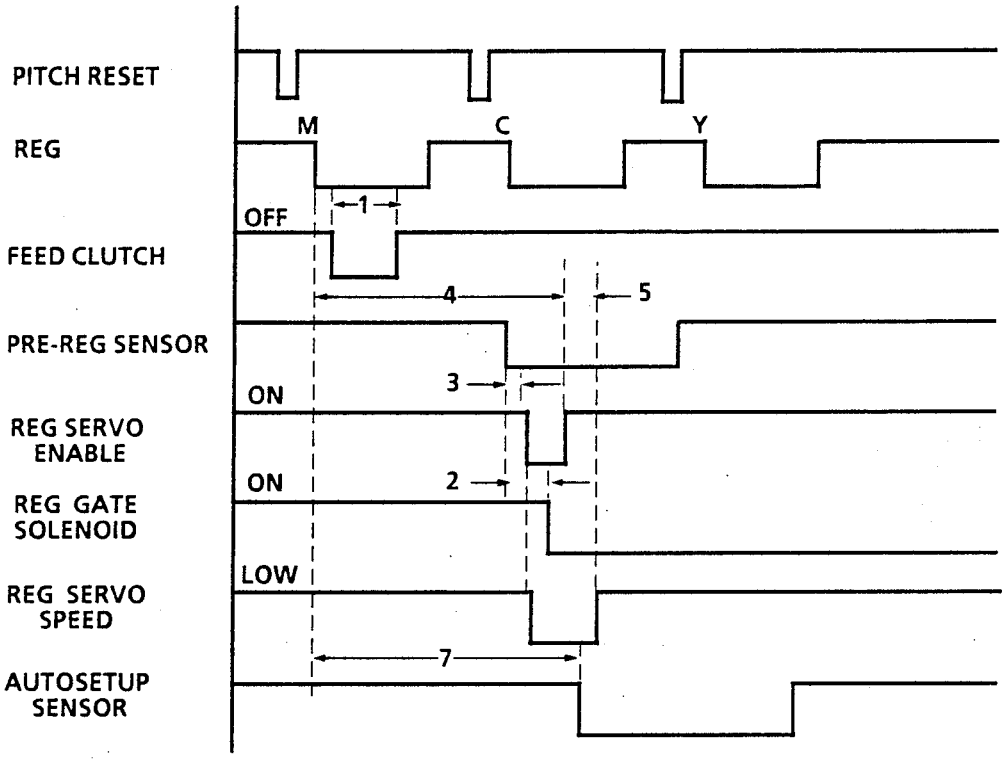
FIG. 3 is a timing diagram.

Referring now to FIG. 2, gripper bar 84 is suspended between two timing belts 54 mounted on rollers 50 and 52. A servo motor 86 is coupled to roller 52 by a drive belt 88. There is a coarse position sensor 90, i.e. the gripper home sensor, which transmits coarse information as to the position of the gripper bar around the loop to the registration control board, which is the servo controller. The registration control board is a position controller so that it can command the gripper bar to be positioned at a specific location at a specific time. Sheet feeder 58 is a friction retard feeder with a servo controlled pre-transfer sheet transport 60 associated therewith. Sheet transport 60 can operate at two speeds, i.e. the printing machine process speed and twice the printing machine process speed. Sheet feeder 58 advances a sheet from stack 56 to transport 60. The sheet is pre-registered by a registration gate 92 advanced into and out of the sheet path by a solenoid 94. The sheet is fed into gripper bar 84 at twice the process speed for 200 milliseconds. The sheet de-skews into the gripper bar. Then servo motor 86 drives belts 54 at the process speed for the duration of the sheet length. A sensor 96 is positioned in the loading zone. Sensor 96 is used to set both the sheet and gripper bar timing to the load zone. Sensor 96 is an optical sensor which is a light emitting diode and a phototransistor. The sensor is triggered based on diffuse reflected light from the object that is to be measured. The sensor is positioned to detect both the gripper bar and the sheet separately when they arrive at the load zone. During normal operation of sheet transport 48, the sensor is also used to detect sheet jams, misgrips, mis-releases, and sheets left on belts 54 before the start of the next job. The timing setup procedure, i.e. calibration of the registration of the sheet with the sheet grippers at the loading zone, is done in a special diagnostic routine that is executed upon initial machine assembly in the manufacturing plant or at a customer's facility, if replacement of the sheet transport or sheet feeder is required. The timing diagram is shown in FIG. 3. The reference signal initiating registration, REG, transitions from high to low at the exact time when ROS 16 has started to write or scan the information from original document 38 onto the photoconductive belt. The objective of the sheet transport is to register the sheet to the reference signal as accurately as possible to maintain accurate image to sheet and image to image registration. The objective of the calibration procedure is to time the sheet and gripper bar to arrive at the loading zone simultaneously. The timing of the gripper bar and the sheet are done separately but referenced to the same physical position in space, a predetermined position in the load zone, which is defined by sensor 96.

Calibration is initiated by disabling sheet feeder 58. The registration control board is commanded to park gripper bar 84 in a nominal position relative to gripper home sensor 90. If the nominal position corresponds to the home position, no correction is required. However, if the nominal position does not coincide with the home position a correction to account for this difference is required. When the reference signal initiates calibration, servo motor 86 is energized to move belts 54 in the direction of arrow 62. In this way, the gripper bar 84 advances from its nominal or home position and passes sensor 96. The arrival time of the gripper bar at the loading zone relative to the reference signal is measured by the master control board while the gripper bar is moving. The measured value is compared to the target time, nominally 3300 milliseconds. If the arrival time of the gripper is less than the target time, then a position correction is made corresponding to the difference between the measured time and target time. The gripper bar is moved from the nominal or home position to a start position further away from the load zone. If the arrival time of the gripper is greater than the target time, then a position correction is made corresponding to the difference between the measured time and the target time. The gripper bar is moved from the nominal or home position to a start position closer to the load zone. The new position correction values are transmitted to the registration control board and the foregoing repeated to verify that the gripper bar arrives at the load zone in the target time of 3300 milliseconds after the reference signal is transmitted.

Next, sheet transport 48 is disabled and the registration control board is commanded to park the gripper bar away from the load zone. Calibration of sheet feeding is initiated by having sheet feeder 58 advance a sheet from stack 56 to transport 60 which, in turn, advances the sheet to the loading zone. The arrival of the sheet at the load zone is detected by sensor 96. The master control board measures the arrival time of the sheet at the loading zone relative to the reference signal. The measured value is compared to the target time of 3300 milliseconds. If the arrival time of the sheet is less than the target time, then the difference is stored as a time delay. Energization of sheet feeder 58 is later by the time delay. If the arrival time of the sheet is greater than the target time, then the difference is stored as a time delay. Energization of sheet feeder 58 is earlier by the time delay. The time delay values are stored in the sheet path servo board and the foregoing repeated to verify that the sheet arrives at the load zone in the target time of 3300 milliseconds after the reference signal is transmitted. In this way, the gripper bar and sheet arrive simultaneously at the load zone. After calibration of the gripper bar and sheet, the sheet transport and sheet feeder are enabled and reliable sheet gripping should occur.

Referring now to the timing diagram of FIG. 3, during the time period indicated by the reference numeral 1, the feed clutch of sheet feeder 58 is off. During the time period indicated by the reference numeral 2, the registration sensor 100 and the registration gate solenoid 94 are off. Registration sensor 100 and servo motor 102 of transport 60 are off during the time period indicated by the reference numeral 3. This causes a buckle in the sheet advanced by sheet feeder 58. During the time period indicated by the reference numeral 4, servo 102 is enabled to determine sheet position. Image position on the sheet is determined during the time period indicated by the reference numeral 7. Servo 102 operates at high speed to form a buckle in the sheet as it is received by the gripper bar during time period 5. Sensor 96 is on during time period 7 to determine the arrival of the sheet and the gripper bar at the loading zone. This time also determines the position of the image on the copy sheet.

In recapitulation, the method of calibrating the arrival of the sheet and the sheet gripper at the loading zone requires that the time of travel from the initial or start position of the sheet and the sheet gripper be substantially identical. In this way, the sheet and sheet gripper arrive simultaneously at the loading zone. This is achieved by measuring the time of travel independently for the sheet and sheet gripper. These measured times are compared to a target time. Deviations in the time of sheet travel are corrected by adjusting the energization time of the sheet feeder. Deviations in the time of travel of the sheet gripper are corrected by adjusting the start position of the sheet gripper.

It is, therefore, evident that there has been provided in accordance with the present invention, a method of calibrating the registration of a sheet with a sheet gripper at a loading zone that fully satisfies the aims and advantages hereinbefore set forth. While this invention has been described in conjunction with a specific method of use thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. A method of calibrating sheet registration with a sheet gripper on a transport, including the steps of:

timing the movement of the sheet gripper moving with the transport from a first reference position until the sheet gripper arrives at a predetermined location in a loading zone to determine a first time;

adjusting the movement of the sheet transport so that the first time is preselected time;

timing the movement of the sheet from a second reference position until the sheet arrives at the predetermined location in the loading zone to determine a second time; and adjusting the movement of the sheet so that the second time is the preselected time so that the sheet and the sheet gripper arrive at the loading zone substantially simultaneously.

2. A method according to claim 1, wherein:

said step of timing the movement of the sheet gripper includes the step of starting movement of the sheet gripper at a reference time corresponding to the time of initiating scanning of information on to a charged photoconductive member; and said step of timing the movement of the sheet includes the step of starting movement of the sheet at the reference time.

3. A method according to claim 2, wherein said step of timing the movement of the sheet gripper includes detecting the arrival of the sheet gripper at the loading station with a sensor.

4. A method according to claim 3, wherein said step of timing the movement of the sheet includes detecting the arrival of the sheet at the loading station with the sensor detecting the arrival of the sheet gripper thereat.

5. A method according to claim 4, further including the step of advancing the sheet from a stack to the loading zone.

6. A method according to claim 5, further including the step of moving the sheet gripper on the transport from a nominal position to the loading zone.

7. A method according to claim 6, wherein said step of adjusting the movement of the transport includes the steps of:

comparing the fist time to a preselected time to determine the difference therebetween; and relocating, in response to said step of comparing, the sheet gripper from the nominal position to a start position.

8. A method according to claim 7, wherein said step of adjusting the movement of the sheet includes the steps of:

comparing the second time to the preselected time to determine a time delay; and storing the time delay to set the time relative to the reference time for the start of said step of advancing.

9. A method of calibrating registration of a sheet gripper on a moving transport with a sheet adapted to be transported by the sheet gripper in a recirculating path in a printing machine to receive a plurality of different color toner images thereon to form a multicolor image, including the steps of:

timing the movement of the sheet gripper moving with the transport from a first reference position until the sheet gripper arrives at a predetermined location in a loading zone to determine a first time;

adjusting the movement of the sheet transport so that the first time is preselected time;

timing the movement of the sheet from a second reference position until the sheet arrives at the predetermined location in the loading zone to determine a second time; and adjusting the movement of the sheet so that the second time is the preselected time so that the sheet and the sheet gripper arrive at the loading zone substantially simultaneously.

10. A method according to claim 9, wherein:

said step of timing the movement of the sheet gripper includes the step of starting movement of the sheet gripper at a reference time corresponding to the time scanning of information on to a charged photoconductive member is initiated; and said step of timing the movement of the sheet includes the step of starting movement of the sheet at the reference time.

11. A method according to claim 10, wherein said step of timing the movement of the sheet gripper includes detecting the arrival of the sheet gripper at the loading station with a sensor.

12. A method according to claim 11, wherein said step of timing the movement of the sheet includes detecting the arrival of the sheet at the loading station with the sensor detecting the arrival of the sheet gripper thereat.

13. A method according to claim 12, further including the step of advancing the sheet from a stack to the loading zone.

14. A method according to claim 13, further including the step of moving the sheet gripper on the transport from a nominal position to the loading zone.

15. A method according to claim 14, wherein said step of adjusting the movement of the transport includes the steps of:

comparing the first time to a preselected time to determine difference therebetween; and relocating, in response to said step of comparing, the sheet gripper from the nominal position to a start position.

16. A method according to claim 15, wherein said step of adjusting the movement of the sheet includes the steps of:

comparing the second time to the preselected time to determine a time delay; and storing the time delay to set the time relative to the reference time for the start of said step of advancing.

* * * * *